US005999787A

United States Patent [19]

Finsterwalder et al.

[11] Patent Number: 5,999,787

[45] Date of Patent: Dec. 7, 1999

[54] FABRIC FUSER FILM

[75] Inventors: Robert N. Finsterwalder, Webster; Robert M. Ferguson, Penfield; Edward L. Schlueter, Jr., Rochester, all of N.Y.

[73] Assignee: Xerox Corporation, Stamford, Conn.

[21] Appl. No.: 09/050,135

[22] Filed: Mar. 30, 1998

[51] Int. Cl.[6] ..... G03G 15/20

[52] U.S. Cl. ..... 399/329; 219/216

[58] Field of Search ..... 399/329, 328, 399/333, 307, 320; 430/124, 97, 99; 347/156; 219/216; 118/59; 427/208.8; 428/447, 448

[56] References Cited

U.S. PATENT DOCUMENTS 5,182,606 1/1993 Yamamoto et al. ..... 219/216 X
5,345,300 9/1994 Uehara et al. ..... 399/329
5,596,041 1/1997 Hashiguchi et al. ..... 525/98
5,600,422 2/1997 Fukami et al. ..... 399/313
5,708,948 1/1998 Chen et al. ..... 399/329
5,732,320 3/1998 Domagall et al. ..... 399/350
5,765,085 6/1998 Law et al. ..... 399/329

*Primary Examiner*—Robert Beatty
*Assistant Examiner*—Sophia S. Chen
*Attorney, Agent, or Firm*—Annette L. Bade

[57] ABSTRACT

A fixing apparatus having a fixing film for use in an electrostatographic apparatus for fusing toner images to a copy substrate, the fixing film having a fabric substrate, and thereover at least one layer, and further having an optional intermediate or adhesive layer positioned between the fabric substrate and layer.

27 Claims, 3 Drawing Sheets

FABRIC FUSER FILM

CROSS REFERENCE TO RELATED APPLICATIONS

Attention is directed to the following copending application assigned to the assignee of the present application: U.S. application Ser. No. 09/056,945 filed Apr. 8, 1998, entitled, "Thermally Conductive Fuser Belt." The disclosure of this application is hereby incorporated by reference in the entirety.

BACKGROUND OF THE INVENTION

The present invention relates to fusing systems, and more specifically, to fixing apparatii comprising fixing films useful for fusing a latent image in an electrostatographic, including digital, machine. In embodiments of the present invention, there are selected fixing films comprising a substrate which comprises a fabric material. In embodiments, an outer layer is positioned over the fibrous substrate. The outer layer comprises a polymer, preferably a fluoropolymer or silicone rubber. In embodiments, the present invention allows for the preparation and manufacture of fixing films with excellent and, in embodiments, superior mechanical properties including superior adhesion of the substrate to the outer layer(s) resulting in a decrease in the occurrence of delamination of the outer layer or layers from the substrate. Also, in embodiments, the films retain sufficient strength at high operating temperatures. The films are also relatively flexible to allow for use in a wide range of environments. In addition, the films allow for a decrease in the occurrence of hot offset, improvement in the image quality and permit a decrease in contamination of other xerographic components such as photoconductors.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known and normally requires heating the toner image to a temperature of between about 90° C. to about 200° C. or higher depending upon the softening range of the particular resin used in the toner. It is undesirable, however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combination of heat, pressure and contact time are provided. The balancing of these parameters to enable the fusing of the toner particles is well known in the art, and can be adjusted to suit particular machines or process conditions.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser, and accordingly it is desired to provide a fusing surface which has a low surface energy to provide the necessary release. To ensure and maintain good release properties of the fuser, it has become customary to apply release agents to the fuser member during the fusing operation. Typically, these materials are applied as thin films of, for example, silicone oils to prevent toner offset.

With the fixing apparatus using a thin film in pressure contact with a heater, the electric power consumption is small, and the warming-up period is significantly reduced or eliminated. In the film embodiments, it is necessary for the film material to comprise a material which is flexible, yet able to maintain its mechanical and electrical properties over a wide temperature range. Problems have resulted in that elastomer materials tend to lose about 70 to 90% of their mechanical strength at high operating temperatures, for example about 190° C. In an attempt to solve the lack of strength problems, multiple layered film systems, for example from 2 to 5 layers, have been developed. However, problems with delamination have occurred with fusing or film systems, which include 2 or more layers, in that the outer surface tends to pull away from the substrate upon multiple revolutions of the belt or film substrate during the fusing process. In addition, processes for preparation of such multilayered fusing films have not been successful at forming uniform thicknesses of the outer layer(s) of the belt or film.

U.S. Pat. No. 5,345,300 discloses a fuser roller in contact with a pressure belt, wherein the pressure belt comprises a material which may be cloth-like.

Therefore, there exists an overall need for a fusing film which is flexible, yet able to maintain adequate mechanical and electrical properties over a wide temperature range. In addition, there exists a need for a fuser film in which the outer layer is sufficiently bonded to the substrate to aid in prevention of delamination of the outer layer from the substrate. Moreover, there exists a need for a fuser film which provides for good release properties and a decrease in the occurrence of hot offset.

SUMMARY OF THE INVENTION

Embodiments of the present invention include: a fixing apparatus, comprising: a) a heater; and in contact with the heater, b) a fixing film comprising a substrate comprising a fabric and having thereon at least one outer layer, wherein an image on a recording material is heated by heat generated from the heater through the fixing film.

These and other objects have further been met by the present invention which also includes, in embodiments: a fixing apparatus, comprising: a) a heater; and in contact with the heater, b) a fixing film comprising a substrate comprising a fabric and having thereon at least one outer layer comprising an elastomer material selected from the group consisting of silicone rubber and fluoroelastomers, wherein an image on a recording material is heated by heat generated from the heater through the outer layer of the fixing film.

Embodiments of the present invention also include: an image forming apparatus for forming images on a recording medium comprising: a charge-retentive surface to receive an electrostatic latent image thereon; a development component to apply toner to the charge-retentive surface to develop the electrostatic latent image to form a developed image on the charge retentive surface; a transfer component to transfer the developed image from the charge retentive surface to a copy substrate; and a fixing component for fixing toner images to a surface of the copy substrate, wherein the fixing component comprises a) a heater; and in contact with the heater, b) a fixing film comprising a substrate comprising a fabric and having thereon at least one outer layer comprising an elastomer material selected from the group consisting of silicone rubber and fluoroelastomers, wherein an image on a recording material is heated by heat generated from the heater through the outer layer of the fixing film.

The fixing members of the present invention, embodiments of which are further defined herein, are flexible, yet able to maintain adequate mechanical and electrical properties over a wide temperature range. In addition, the fixing members herein comprise at least one outer layer which is sufficiently bonded to the substrate to aid in prevention of delamination of the outer layer from the substrate. Further, in embodiments, the thickness of the outer layer(s) can be adequately controlled. Moreover, the fusing films herein provide for good release properties and a decrease in the occurrence of hot offset.

BRIEF DESCRIPTION OF THE DRAWINGS

For a better understanding of the present invention, reference may be had to the accompanying figures.

DETAILED DESCRIPTION OF THE PRESENT INVENTION

The present invention relates to fixing systems comprising fixing members, and, in embodiments, a heating apparatus comprising a heater generating heat and a fixing film in contact with the heater, wherein an image on a recording material is heated by heat from the heater through the film, and wherein the film comprises a substrate comprising a fabric material, and having thereon at least one outer layer.

Figure 1:
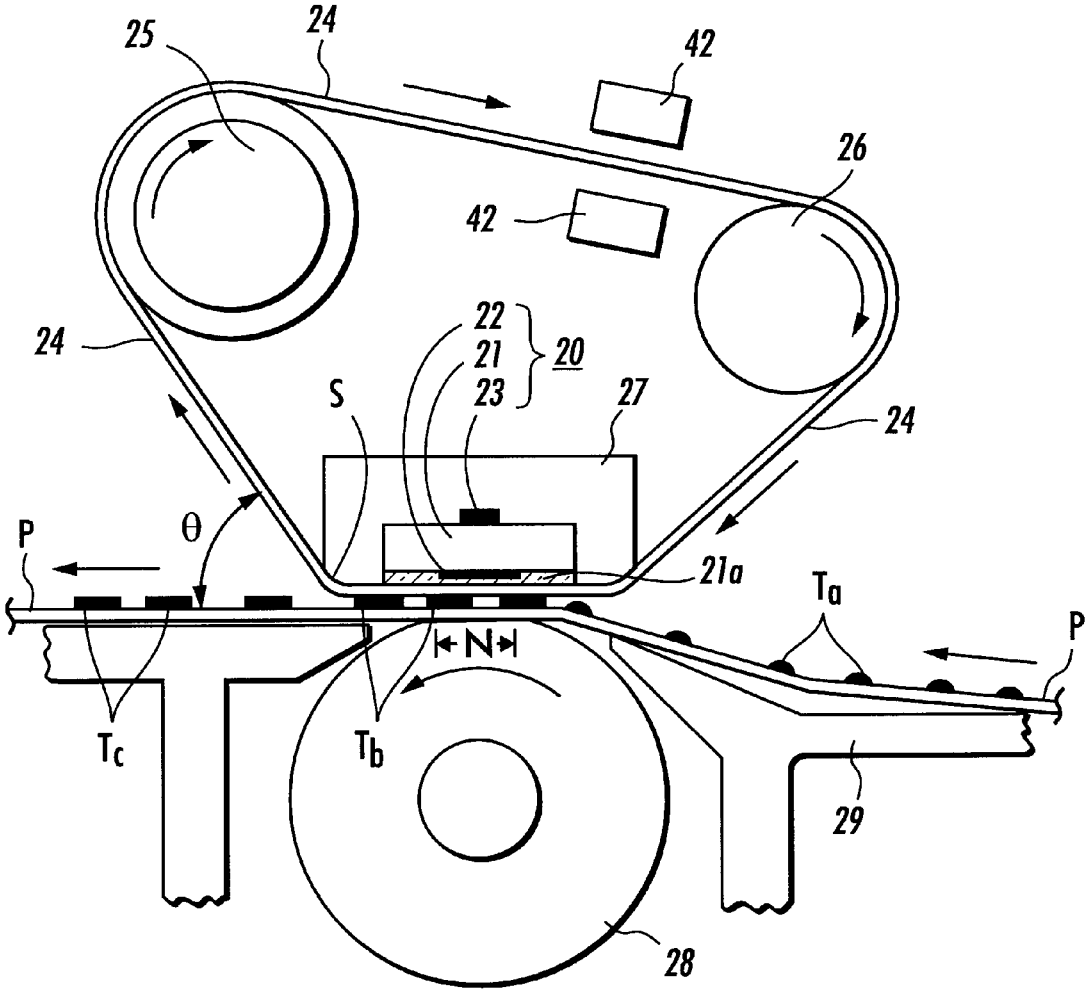
FIG. 1 is a sectional view of a fixing apparatus according to an embodiment of the invention.

FIG. 1 shows a sectional view of an example of a heating apparatus according to an embodiment of the present invention. In FIG. 1, a heat resistive film or an image fixing film 24 in the form of an endless belt is trained or contained around three parallel members, i.e., a driving roller 25, a follower roller 26 of metal and a low thermal capacity linear heater 20 disposed between the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image thereon (not shown) so that the film is not creased, skewed or delayed.

A pressing roller 28 has a rubber elastic layer with parting properties, such as silicone rubber or the like, and is press-contacted to the heater 20 with the bottom travel of the fixing film 24 therebetween. The pressing roller is pressed against the heater at the total pressure of 4–7 kg by an urging means (not shown). The pressure roller rotates co-directionally, that is, in the counterclockwise direction, with the fixing film 24.

The heater 20 is in the form of a low thermal capacity linear heater extending in a direction crossing with the film 24 surface movement direction (film width direction). It comprises a heater base 27 having a high thermal conductivity, a heat generating resistor 22 generating heat upon electric power supply thereto, and a temperature sensor 23. It is mounted on a heater support 21 having high thermal conductivity.

The heater support 21 supports the heater 20 with thermal insulation on an image fixing apparatus and is made from high heat durability resin such as PPS (polyphenylene sulfide), PAI (polyamideimide), PI (polyimide), polyaramide, polyphthalamide, polyketones, PEEK (polyether ether ketone) or liquid crystal polymer material, or a compound material of such resin material and ceramics, metal, glass or the like material.

An example of the heater base 27 is in the form of an alumina plate having a thickness of 1.0 mm, a width of 10 mm and a length of 240 mm comprised of a high conductivity ceramic material.

The heat generating resistor material 22 is applied by screen printing or the like along a longitudinal line substantially at the center, of the bottom surface of the base 27. The heat generating material 22 is, for example, Ag/Pd (silver palladium), $Ta_2N$ or another electric resistor material having a thickness of approximately 10 microns and a width of 1–3 mm. It is coated with a heat resistive glass 21*a* in the thickness of approximately 10 microns, as a surface protective layer. A temperature sensor 23 is applied by screen printing or the like substantially at a center of a top surface of the base 27 (the side opposite from the side having the heat generating material 22). The sensor is made of Pt film having low thermal capacity. Another example of the temperature sensor is a low thermal capacity thermistor contacted to the base 27.

The linear or stripe heater 22 is connected with the power source at the longitudinal opposite ends, so that the heat is generated uniformly along the heater. The power source in this example provides AC 100 V, and the phase angle of the supplied electric power is controlled by a control circuit (not shown) including triac in accordance with the temperature detected by the temperature detecting element 23.

A film position sensor 42 in the form of a photocoupler is disposed adjacent to a lateral end of the film 24. In response to the output of the sensor, the roller 26 is displaced by a driving means in the form of a solenoid (not shown), so as to maintain the film position within a predetermined lateral range.

Upon an image formation start signal, an unfixed toner image is formed on a recording material at the image forming station. The recording material sheet P having an unfixed toner image Ta thereon is guided by a guide 29 to enter between the fixing film 24 and the pressing roller 28 at the nip N (fixing nip) provided by the heater 20 and the pressing roller 28. Sheet P passes through the nip between the heater 20 and the pressing roller 28 together with the fixing film 24 without surface deviation, crease or lateral shifting while the toner image carrying surface is in contact with the bottom surface with the fixing film 24 moving at the same speed as sheet P. The heater 20 is supplied with electric power at a predetermined timing after generation of the image formation start signal so that the toner image is heated at the nip so as to be softened and fused into a softened or fused image Tb.

Fixing film 24 is sharply bent at an angle theta θ of, for example, about 45 degrees at an edge S (the radius of curvature is approximately 2 mm), that is, the edge having a large curvature in the heater support 21. Therefore, the sheet advanced together with the film 24 in the nip is separated by the curvature from the fixing film 24 at edge S. Sheet P is then discharged to the sheet discharging tray. By the time Sheet P is discharged, the toner has sufficiently cooled and solidified and therefore is completely fixed (toner image Tc).

The toner of resin and pigment used in this embodiment has a sufficiently high viscosity when it is heated and fused. Therefore, even if the toner temperature when it is separated from the fixing film is higher than the toner fusing point, the bonding strength among toner particles is very large when compared to the strength between the toner and the fixing films. Therefore, practically no toner offset is produced and carried over onto fixing film 24 when fixing film 24 and sheet P is separated.

In this embodiment, heat generating element 22 and base 27 of heater 20 have low thermal capacity. In addition, heater element 22 is supported on support 21 through thermal insulation. The surface temperature of heater 20 in the nip quickly reaches a sufficiently high temperature which is necessary in order to fuser the toner. Also, a stand-by temperature control is used to increase the temperature of the heater 20 to a predetermined level. Therefore, power consumption can be reduced, and rise in temperature can be prevented.

The fixing film is in contact with the heater. The distance between the outer layer of the fixing film and the heater is preferably not less than 2.5 mm, and preferably not less than 5 mm. Similarly, the distance between the fixing film and the grounded rollers 25 and 26 is not less than 5 mm. These distances prevent leakage of the charge applied to the transfer material P by an image (not shown) forming station from leaking to the ground through the transfer material P. Therefore, possible deterioration of image quality due to improper image transfer can be avoided.

In another embodiment of the invention, not shown in the figures, the fixing film may be in the form of a sheet. For example, a non-endless film may be rolled on a supply shaft and taken out to be wrapped on a take-up shaft through the nip between the heater and the pressing roller. Thus, the film may be fed from the supply shaft to the take-up shaft at the speed which is equal to the speed of the transfer material. This embodiment is described and shown in U.S. Pat. No. 5,157,446, the disclosure of which is hereby incorporated by reference in its entirety.

Figure 2:
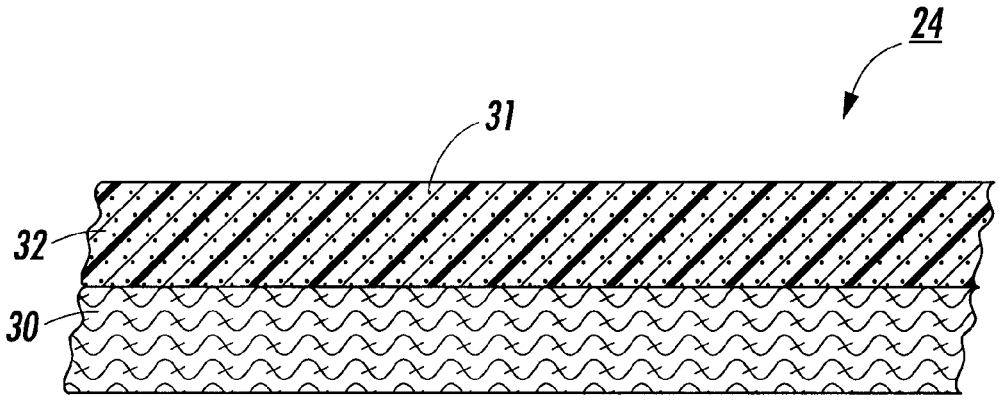
FIG. 2 is an illustration of an embodiment of the invention, wherein a two layer fixing film described herein is shown.

The fixing film of the present invention can be of different configurations. In one embodiment of the invention, the fixing film 24 is of a two layer configuration as shown in FIG. 2. Preferably, substrate layer 30 is comprised of a fabric material. Fixing film 24 has an outer layer 32 positioned on the substrate 30. The outer layer preferably comprises an elastomeric material such as, for example, fluoroelastomer or silicone rubber with an optional filler 31 dispersed therein.

Figure 3:
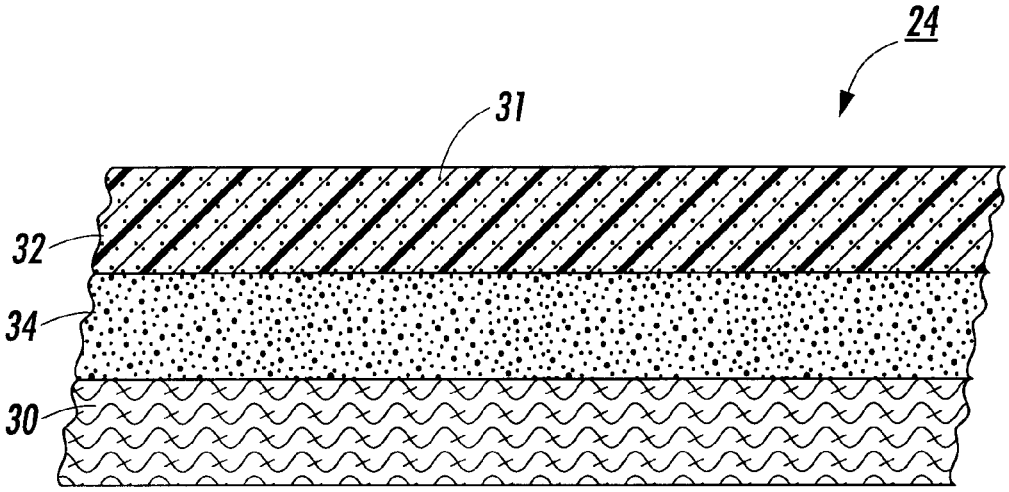
FIG. 3 is an illustration of an embodiment of the invention, wherein a three layer fixing film as described herein is exemplified.

In another embodiment of the invention, the fixing film 24 is of a three layer configuration as shown in FIG. 3. As shown in FIG. 3, the fixing film comprises a substrate 30 comprising a fabric material, and thereover an adhesive material 34, and positioned on the adhesive, an outer layer 32 preferably comprising an elastomeric material.

The fuser film of the present invention may have additional layers of from about 1 to about 5 layers positioned between the fabric substrate and the outer layer. These additional layers may be adhesive layers, reinforcing layers, and the like. The various layers impart mechanical strength, image and toner compatibility and proper nip dynamics to enable high quality images with little distortion at high process speeds. The base layer provides for mechanical strength and promotes adhesion. The top layer provides superior image release in either liquid powder archetectures.

The substrate of the fixing film of the present invention comprises a fabric material. Fabric, as used herein, refers to a textile structure comprised of mechanically interlocked fibers or filaments, which may be woven or nonwoven. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. The fabric material useful as the substrate herein must be suitable for allowing a high operating temperature (i.e., greater than about 180° C., preferably greater than 200° C.), capable of exhibiting high mechanical strength, providing heat insulating properties (this, in turn, improves the thermal efficiency of the proposed fusing system), and possessing electrical insulating properties. In addition, it is preferred that the fabric substrate have a flexural strength of from about 2,000,000 to about 3,000,000 psi, and a flexural modulus of from about 25,000 to about 55,000 psi. Examples of suitable fabrics include woven or nonwoven cotton fabric, graphite fabric, fiberglass, woven or nonwoven polyimide for example KELVAR® available from DuPont), woven or nonwoven polyamide, such as nylon or polyphenylene isophthalamide (for example, NOMEX® of E. I. DuPont of Wilmington, Del.), polyester, polycarbonate, polyacryl, polystyrene, polyethylene, polypropylene, cellulosed, ppolysulfone, polyxylene, polyacetal, and the like.

The film is from about 3 to about 36 inches, preferably from about 4 to about 20 inches in circumference. The width of the film is from about 8 to about 30 inches. It is preferably that the substrate be an endless, seamed flexible belt and seamed flexible belts, which may or may not include puzzle cut seams. Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

Examples of the outer layers of the fixing film herein include polymers such as silicone rubbers and fluoroelastomers. Examples of suitable silicone rubbers include dimethylsilicones, liquid silicone rubbers such as vinyl cross linked heat heat curable rubbers or silanol room temperature cross linked materials.

Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein these fluoroelastomers, particularly from the class of copolymers and terpolymers of vinylidenefluoride, hexafluoropropylene, and tetrafluoroethylene, and tetrapolymers of vinylidenefluoride, hexafluoropropylene, tetrafluoroethylene, and a cure site monomer are known commercially under various designations as VITON A®, VITON E®, VITON E60C®, VITON E430®, VITON 910®, VITON GH® and VITON GF®. The VITON® designation is a Trademark of E. I. DuPont de Nemours, Inc. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer. Other commercially available fluoroelastomers include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly (propylene-tetrafluoroethylenevinylidenefluoride) both also available from 3M Company, as well as the TECNOFLONS identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON GF®, available from E. I. DuPont de Nemours, Inc. The VITON GF® has 35 mole percent of vinylidenefluoride, 34 mole percent of hexafluoropropylene and 29 mole percent of tetrafluoroethylene with 2 percent cure site monomer.

Examples of fluoroelastomers suitable for use herein for the outer layer of the fixing film include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the fuser member or conductive film surface.

In embodiments, the polyorganosiloxane having functionality according to the present invention has the formula:

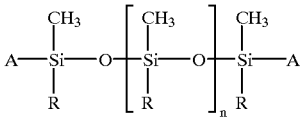

where R is an alkyl from about 1 to about 24 carbons, or an alkenyl of from about 2 to about 24 carbons, or a substituted or unsubstituted aryl of from about 4 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. Functional group A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

In the two layer configuration, the outer layer of the fixing film herein is deposited on the substrate via a well known coating processes. Known methods for forming the outer layer on the substrate film such as dipping, spraying such as by multiple spray applications of very thin films, casting, flow-coating, web-coating, roll-coating, or the like can also be used. In the three layer configuration, the intermediate adhesive layer may be deposited on the substrate in the a similar manner as the outer layer is deposited on the substrate. Similarly, in the three layer configuration, the outer layer may be deposited on the intermediate layer in any of the suitable manners just described. In a particularly preferred embodiment of the invention, the layer(s) are deposited by flow-coating.

Flow coating the outer layer to the fabric substrate provides an outer layer which is less susceptible to delamination or pulling away from the substrate. Details of a flow coating procedure useful in preparing fixing films of the present invention can be found in U.S. application Ser. No. 08/669,761 filed Jun. 26, 1996, entitled, "LEVELING BLADE FOR FLOW COATING PROCESS FOR MANUFACTURE OF POLYMERIC PRINTER ROLL AND BELT COMPONENTS;" U.S. application Ser. No. 08/672,493 filed Jun. 26, 1996, entitled, "FLOW COATING PROCESS FOR MANUFACTURE OF POLYMERIC PRINTER ROLL AND BELT COMPONENTS;" U.S. application Ser. No. 08/824,576, filed Mar. 26, 1997, entitled "FUSER MEMBER WITH AN AMINO SILANE ADHESIVE LAYER AND PREPARATION THEREOF;" and U.S. application Ser. No. 08/822,521 filed Mar. 24, 1997, entitled "FLOW COATING SOLUTION AND FUSER MEMBER LAYERS PREPARED THEREWITH." The subject matter of each of these applications is incorporated herein in their entirety.

Generally, the flow coating process involves dripping material spirally over a horizontally rotating film. Generally, in this flow coating method, the coating is applied to the substrate, in this case a film substrate, by rotating the substrate in a horizontal position about a longitudinal axis and applying the coating from an applicator to the substrate in a spiral pattern in a controlled amount so that substantially all the coating that exits the applicator adheres to the substrate. By flow coating onto the substrate, the outer layer sufficiently bonds and/or penetrates to or into the substrate in order to decrease the occurrence of delamination. In addition, the outer layer is deposited on the substrate in a manner wherein the thickness uniformity is increased. Moreover, by flow coating the outer surface onto the substrate, the surface of the outer layer is smoother, for example, having a gloss of from about 50 to about 100, and preferably 80 Gardner Gloss Units. In addition, with flow coating, the outer layer is thick enough for toner conformation to rough substrates.

Figure 4:
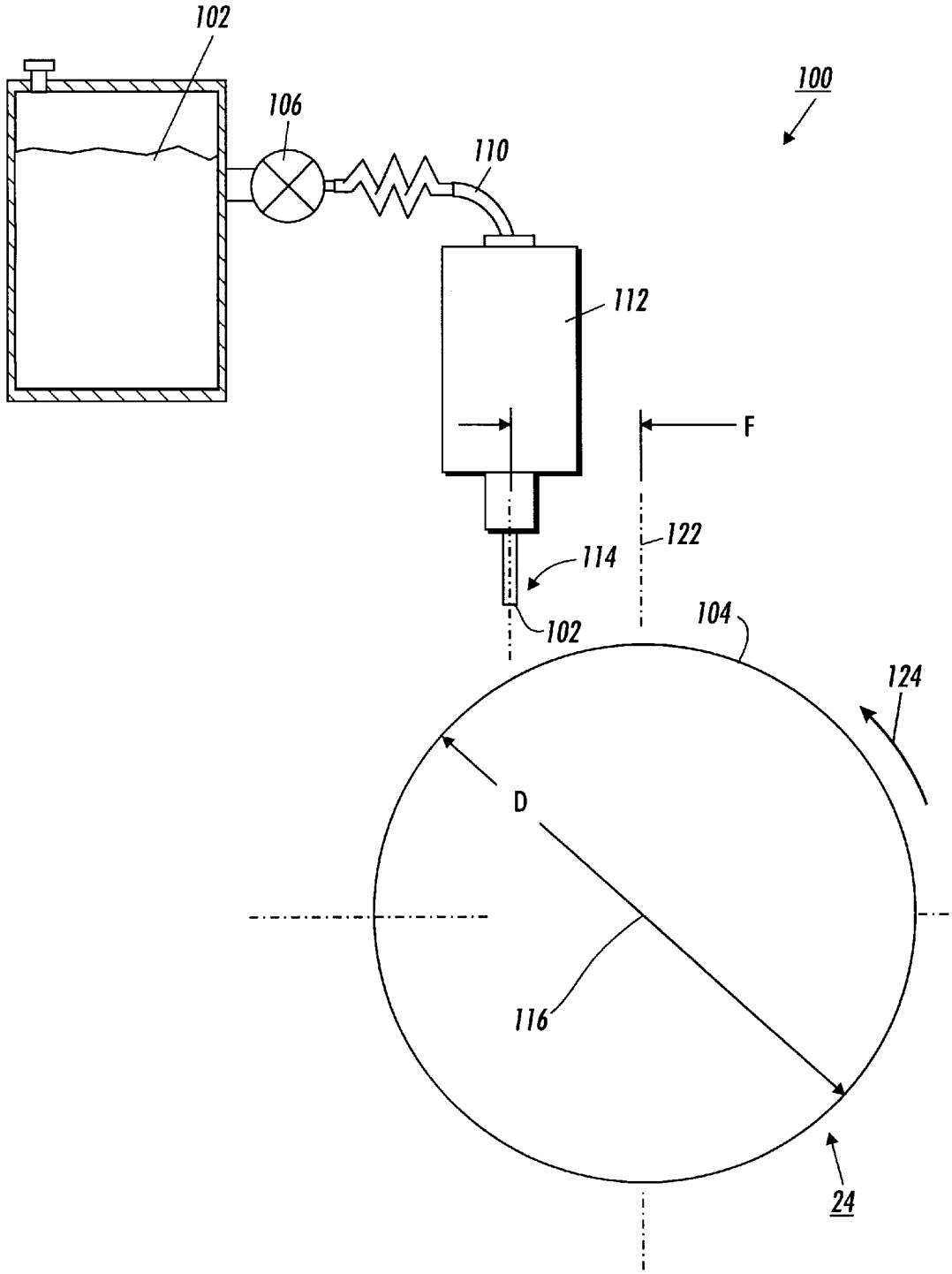
FIG. 4 is an illustration of an embodiment of the invention, wherein a flow coating apparatus is defined.

Referring to FIG. 4, an example of a preferred embodiment of a flow coating apparatus 100 is depicted. Apparatus 100 is used to apply coating solution 102 to periphery 104 of the fuser sleeve 24. The coating solution is pumped via pump 106 through a conduit typically in the form of a pipe 110 to an applicator 112 including nozzle 114 through which the coating solution 102 flows onto periphery 104 of the fuser sleeve 24.

The coating solution 102 is applied to the periphery 104 in a spiral fashion in which the fuser sleeve 24 rotates about its longitudinal axis 116 while in a horizontal position, while the applicator 112 translates in a direction parallel to the longitudinal axis 116 of the fuser sleeve 24 along the length of the substrate in a horizontal position. The coating solution 102 is thus applied to the periphery 104 of the fuser sleeve 24 in a spiral fashion. The application of the coating is similar to the path of a cutting tool when turning the periphery of a shaft in a standard lathe. By accurately controlling the amount of coating solution 102 that is displaced through pump 106 and/or by controlling accurately in any manner the amount of coating solution 102 that is released at the nozzle 114 of applicator 112, substantially all the coating solution 102 that passes through the nozzle 114 adheres to the sleeve 24. The amount of coating released through the applicator per rotation in order to obtain sufficient coating depends mostly on the viscosity of the coating, the size (circumference and length) of the fuser member to be coated, the desired thickness of the layer, the rate of flow of the coating, and other like parameters. By making the correct calculations, flow coating can be achieved wherein substantially all of the coating from the applicator adheres to the surface of the fuser member. "Substantially all" as used herein means from about 80 to about 100 percent of the coating initially released from the nozzle will adhere to the fuser member. Preferably from about 95 to about 100 percent will adhere to the fuser member. In other words, preferably about 95 to about 100 percent of the solution coating applied to the sleeve adheres to the sleeve substrate.

Using flow coating, a very fine coating may be precisely coated onto a substrate. In particular, Applicants have been successful in obtaining a coating layer of about 0.0020 inches with a tolerance range of +/−0.0001 inches. Being able to control the thickness of the coating with such precision will virtually obviate the need for grinding and other post coating operations particularly for use in fusing color images where glossy finish on images is preferred. For black and gray tone images where a flat image is preferred, however, the surface may be too smooth following flow coating. Therefore, subsequent grinding and or polishing operations may be required to obtain the preferred dull or flat finish.

Apparatus 100 may have any suitable form and consists of any equipment capable of rotating the fuser sleeve 24 about longitudinal axis 116 while translating the applicator 112 in a direction parallel to the longitudinal axis 116 of the fuser sleeve 24. Standard CNC (computerized numerical control) or engine lathes may be used for this purpose. Specialty equipment may also be designed which will rotate the fuser sleeve while translating the applicator. Specialized equipment may be advantageous to permit the proper enclosure of the apparatus 100 to contain possible volatile coating solutions and to maintain specific environmental conditions necessary for quality coatings from this process.

When applying the coating using an apparatus 100 with an applicator 112 which applies a spiral coating through the nozzle 114, the coating is applied in a thread-like fashion and may have peaks and valleys on the periphery 104 of the sleeve 24. The placement of a member in the form of guide 120 against the periphery 104 of the sleeve 24 as the coating solution 102 is applied to the sleeve, significantly improves the uniformity of the coating upon the sleeve. Preferably, the longitudinal axis 116 of the sleeve 24 is positioned horizontally with respect to the floor of the building in which the apparatus is housed. This configuration permits for the affects of gravity to properly distribute the coating solution 102 about the periphery 104 of the sleeve 24. Further details of this preferred embodiment of the present invention, wherein a blade is used at the periphery of the sleeve in order to improve the uniformity of the coating, are provided in commonly assigned U.S. application Ser. No. 08/669,761 filed Jun. 26, 1996, entitled, "Leveling Blade for Flow Coating Process for Manufacture of Polymeric Printer Roll and Belt Components."

Similarly, the applicator 112 is preferably positioned above the fuser sleeve 24 so that the stream of coating solution coming from the nozzle 114 may rest upon the periphery 104 of the sleeve 24. Preferably, tip 102 of nozzle 114 is spaced a distance H above the periphery 104 of the sleeve 24. If the tip 120 is placed too far from the periphery 104 the coating solution 102 will evaporate before it reaches the periphery. If the tip 120 is placed too closely to the periphery 104, the tip will hit the periphery 104. For a sleeve having a diameter D of approximately four inches, a distance of approximately ¼ of an inch from the tip 102 to the periphery 104 is adequate. Positioning of the applicator 112 at a position F of approximately one inch from vertical axis 122 of the roll in the direction of rotation 124 of the sleeve is sufficient. The dynamics of the rotation of the roll and its position on the periphery of the sleeve assist in the uniform distribution of the solution 102 on the periphery of the sleeve.

It is preferred that the outer fusing layer be coated to a thickness of from about 1 to about 15 mils, preferably from about 3 to about 10 mils. Specifically, in the elastomer solution coating, the elastomer is present in an amount of from about 10 to about 40 percent, preferably about 15 to about 35 percent by weight of total solids. For silicone rubber systems, the solids content is from about 50 to about 100, and preferably from about 55 to about 80 weight percent of total solids. Total solids as used herein in reference to the outer elastomer layer refers to the total amount of elastomer, and any agents or solids such as dehydrofluorinating agent, adjuvants, fillers, crosslinking agent, and conductive fillers.

Conductive fillers may be dispersed in a fusing layer of the fuser member of the present invention. In a preferred embodiment a metal oxide or carbon black is dispersed in the elastomer surface. A preferred metal oxide is one which is capable of interacting with the functional groups of the polymeric release agent which is used in a preferred embodiment, to form a thermally stable film which releases the thermoplastic resin toner and prevents the toner from contacting the elastomer material itself. In addition, it is important that the metal oxide be substantially non-reactive with the elastomer so as not to chemically react with the elastomer material. A preferred metal oxide is cupric oxide, which has been found to be a weak base and softens rather than hardens the elastomer with time thereby maintaining good copy quality. Another preferred metal oxide is aluminum oxide. In a particularly preferred embodiment, fillers include a combination of aluminum oxide and cupric oxide. Other metal oxide options include nickel oxide, ferric oxide, manganese oxide, molybdenum oxide, and the like. The metal oxide is typically present in an amount of from about 5 to 30 parts by weight per hundred parts of the elastomer although it is preferred to have from about 10 to 20 parts by weight of metal oxide. In addition, the particle size of the metal oxide is important and it should not be so small as to interfere with the curing of the elastomer nor so large as to supply an insufficient number of particles disbursed throughout the elastomer surface for good release properties. Typically, the metal oxide particles have a mean diameter of from about 2 to 10 microns, preferably 6 microns.

In a preferred embodiment of the invention, a fluoroelastomer is used as the outer surface material. The dehydrofluorinating agent which attacks the fluoroelastomer generating unsaturation is selected from basic metal oxides such as MgO, CaO, $Ca(OH)_2$ and the like, and strong nucleophilic agents such as primary, secondary and tertiary, aliphatic and aromatic amines, where the aliphatic and aromatic amines have from about 2 to about 30 carbon atoms. Also included are aliphatic and aromatic diamines and triamines having from about 2 to about 30 carbon atoms where the aromatic groups may be benzene, toluene, naphthalene, anthracene, and the like. It is generally preferred for the aromatic diamines and triamines that the aromatic group be substituted in the ortho, meta and para positions. Typical substituents include lower alkyl amino groups such as ethylamino, propylamino and butylamino, with propylamino being preferred.

In a preferred embodiment, the outer layer is flow coated on the fabric substrate, or over an intermediate or adhesive layer. In the case of flow coating a fluoroelastomer or silicone rubber, it is desirable that a crosslinking agent be added, and that the elastomer or rubber and crosslinking agent dissolve completely in the solvent and remain dissolved throughout the flow coating procedure. It is further necessary that the fluoroelastomer or rubber and/or curing agent dissolved in solvent strike a balance between flowability and viscosity as described above. Also, it is desirable for the flow coating solution to have a suitable balance of viscosity and evaporation rate (drying) to enable single pass uniform thickness coatings which impact throughput and adhesion performance.

A solvent suitable for dissolving a fluoroelastomer or silicone rubber is be used in the present invention when a fluoroelastomer is chosen as the outer surface material. Further, a crosslinking or curing agent is preferably used to stimulate crosslinking of the fluoroelastomer or silicone rubber. The solvent must have the ability to thoroughly dissolve the fluoroelastomer or silicone rubber into solution form. Also, the combination of solvent, fluoroelastomer or silicone rubber, and crosslinking and/or curing agent, should react so as to prevent the formation of precipitates or crystallites which tend to clog the filters and pump of the flow coating apparatus, and which may cause bubbles or defects in the final coated fuser member. Further, the solvent and crosslinking or curing agents must possess properties which allow for the coating solution of solvent, fluoroelastomer or silicone rubber, crosslinking agent or curing agent to remain in solution form during the entire flow coating manufacturing process which may take from 8 hours to a few days.

Examples of suitable solvents include effective solvents. Effective solvents as used herein are solvents which when mixed with a fluoroelastomer or silicone rubber and curing or crosslinking agents, possess the ability to completely dissolve the fluoroelastomer or silicone rubber in order to enable the fluoroelastomer to be flow coated, without allowing for precipitates to form during the flow coating process. Preferred solvents have the ability to completely dissolve the curing/crosslinking agent and are compatible with the fluoroelastomer or silicone rubber solvent solution enabling the coating solution to be flow coated in a manufacturing environment which may last a few days, for example from about 1 to about 4 days. Effective solvents include polar solvents such as water, methyl alcohol, ethyl alcohol, acetone, methyl ethyl ketone and methyl iso-butyl ketone, along with the Wittig reaction solvents such as dimethyl formamide (DMF), dimethyl sulfoxide (DMSO) and N-methyl 2 pyrrolidone (NMP). Preferred solvents are the Wittig reaction solvents, and particularly preferred are dimethyl formamide (DMF), dimethyl sulfoxide (DMSO) and N-methyl 2 pyrrolidone (NMP). Of these, N-methyl 2-pyrrolidone is particularly preferred since DMF is a possible carcinogen and DMSO generates environmentally unfriendly sulfur by-products upon thermal oxidation. Specifically, for fluoroelastomers, the solvent is added in an amount of from about 60 to about 90 percent, preferably from about 65 to about 85 percent by weight of total solids. For silicone rubbers, the solvent is added in an amount of from about 0 to about 50 percent, and preferably from about 1 to about 30 percent by weight of total solids.

The preferred curing and/or crosslinking agents are the nucleophilic curing agents such as VITON CURATIVE VC-50® which incorporates an accelerator (such as a quaternary phosphonium salt and a crosslinking agent (bisphenol AF); DIAK 1 (hexamethylenediamine carbamate) and DIAK 3 (N,N'-dicinnamylidene-1,6 hexanediamine). The curing and/or crosslinking agent is added in an amount of from about 1 to about 10 weight percent, and preferably from about 2 to about 7 weight percent of fluoroelastomer solids.

It is preferred that the viscosity of the flow coating solution comprising a fluoroelastomer, nucleophilic crosslinking agent and effective solvent, be from about 200 to about 3500, and preferably from about 250 to 2500 centipoise. Viscosities in this range provide adequate flowability and enable thin coatings which exhibit superior adhesion. It is also desirable for the coating solution to be slow drying in order to avoid trapping solvent in the underlayers which may cause bubble formation. In addition, it is desirable to evaporate the solvent with heat for about 5 to about 60 minutes. The fluoroelastomer can then be cured for an extended period of time at elevated temperatures. Silicones can be evaporated under similar or the same conditions, but typically are cured at lower times and temperatures than fluoroelastomer materials.

In the case of silicone rubbers, these materials are typically liquids or semi-liquids which may or may not require solvents in the amount specified above. Solvents can be used to adjust the viscosity and flow characteristics. the curing systems vary with the chemistry of the silicones. Liquid silicone rubbers can be vinyl addition cured by, for example, platinum complexes of organic compounds. Room temperature silicone rubbers (RTV) can be cure initiated by, for example, tin complexes of diacetates, dilaurates or dioctates. The choice of the curing agent can be dictated by the rate of the cure desired to obtain the final mechanical properties, coating appearance and throughput.

Other adjuvants and fillers may be incorporated in the elastomer in accordance with the present invention as long as they do not affect the integrity of the elastomer. Such fillers normally encountered in the compounding of elastomers include coloring agents, reinforcing fillers, and processing aids.

Any suitable release agent may be used including polyorganosiloxane fluids, amino oils, and the like. Preferred polymeric fluid release agents are those having functional groups which interact with the metal oxide particles in the fuser member in such a manner to form an interfacial barrier at the surface of the fuser member while leaving a non-reacted low surface energy release fluid as an outer release film. Examples of suitable release agents having functional groups include those described in U.S. Pat. Nos. 4,046,795; 4,029,827; and 4,011,362; 4,101,686; 4,146,659; 4,150,181; 4,185,140; 4,515,884; 5,395,725; and 5,493,326. In preferred embodiments, the chemically reactive groups of the polymeric release agents are mercapto, carboxy, hydroxy, isocyanate, epoxy and amino. Preferred amino functional oils include those disclosed in, for example, U.S. Pat. Nos. 5,512,409; 5,516,361 and 5,531,813. Other preferred fuser oils include hydride oils such as those disclosed in U.S. Pat. No. 5,401,570. In the case of a silicone rubber outer layer, it is preferred to use polydimethylsiloxane fuser oils. In the case of a fluoroelastomer outer layer, it is preferred to use amino functional oils.

Optional intermediate adhesive layers and/or intermediate layers may be applied to achieve desired properties and performance objectives of the present fixing film. In a preferred embodiment of the invention, the adhesive or intermediate layer is applied to the film substrate by a flow coating procedure, and the outer layer is subsequently applied to the film over the adhesive layer also by use of the flow coating procedure.

Preferred adhesives for use with the flow coating procedure include amino silane compositions comprising compounds having the following Formula I:

Formula I $$R_1—Si—(R_2)_3$$

wherein $R_1$ is selected from the group consisting of an amino group such as $NH_2$; an aminoalkyl of from about 1 to about 10 carbon atoms, preferably from about 2 to about 5 carbon atoms, such as aminomethyl, aminoethyl, aminopropyl, aminobutyl, and the like; an alkene of from about 2 to about 10 carbon atoms, preferably from about 2 to about 5 carbon atoms, such as ethylene, propylene, butylene, and the like; and an alkyne of from about 2 to about 10 carbon atoms, preferably from about 2 to about 5 carbon atoms, such as ethyne, propyne, butyne and the like; and wherein $R_2$ is an alkoxy group of from about 1 to about 10 atoms, preferably from about 2 to about 5 carbon atoms, such as methoxy, ethoxy, propoxy, and the like. In a preferred embodiment, in the amino silane compound of Formula I, $R_1$ is selected from the group consisting of aminomethyl, aminoethyl, aminopropyl, ethylene, ethyne, propylene and propyne, and $R_2$ is selected from the group consisting of methoxy, ethoxy, and propoxy.

In an even more preferred embodiment of the invention, the amino silane composition comprises a compound selected from the group consisting of a compound having the following Formula II:

Formula II:

$$R_3—Si—(R_4)_3$$

wherein $R_3$ is an amino group such as $NH_2$ or an aminoalkyl of from about 1 to about 10 carbon atoms such as aminomethyl, aminoethyl, aminopropyl, aminobutyl, and the like, and wherein $R_4$ is an alkoxy group of from about 1 to about 10 atoms such as methoxy, ethoxy, propoxy, and the like; a compound selected from the following Formula III:

Formula III:

$$R_5—Si—(R_6)_3$$

wherein $R_5$ is selected from the group consisting of an alkene of from about 2 to about 10 carbon atoms such as ethylene, propylene, butylene, and the like, and an alkyne of from about 2 to about 10 carbon atoms such as ethyne, propyne, butyne and the like, and wherein $R_6$ is an alkoxy group of from about 1 to about 10 atoms such as methoxy, ethoxy, propoxy, and the like; and combinations of compounds of Formula II and Formula III.

Amino silane compositions used in adhesion applications typically contain alkoxy and other functional groups such as vinyls, aryl or alkyl amino groups. In a preferred embodiment, the adhesive amino silane composition further comprises an organic phosphonium catalyst in addition to the amino silane compound(s). A preferred organic phosphonium catalyst is of the following Formula IV:

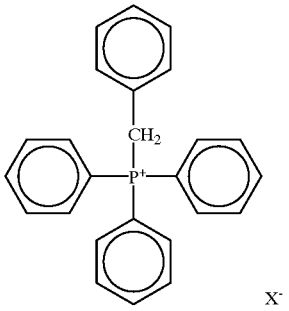

wherein X is a halogen selected from the group consisting of chlorine, fluorine, bromine, and iodine. In an even more preferred embodiment, X is chlorine.

Examples of amino silane compositions include aminopropyl triethoxy silane, aminoethyl triethoxy silane, aminopropyl trimethoxy silane, aminoethyl trimethoxy silane, ethylene trimethoxy silane, ethylene triethoxy silane, ethyne trimethoxy silane, ethyne triethoxy silane, and combinations thereof. In preferred embodiments, the amino silane compositions further comprise a benzyltriphenylphosphonium catalyst such as benzyltriphenylphosphonium chloride. A specifically preferred adhesive coating comprises an amino silane adhesive composition comprising 1-propamine 3-(triethoxy)silane, ethynyltriethoxy silane, and benzyltriphenylphosphonium chloride (also written as 1-propamine, 3-(triethoxysilyl)silane, ethynyltriethoxy, benzyltriphenylphosphonium chloride).

The use of these preferred adhesives allow for sufficient flow coating including stability to the overcoat, thickness uniformity and decrease in delamination and performance in testing provide excellent results by use of the above adhesive compositions. Particularly effective commercially available materials include CHEMLOCK® 5150 (1-propamine, 3-(triethoxysilyl)silane, ethynyltriethoxy, benzyltriphenylphosphonium chloride) available from Lord Elastomer Products.

It is desirable that the adhesive possess suitable properties to allow for flow coating thereof. For example, it is desirable that the adhesive be flowable and sufficiently viscous in order to remain on the substrate without dripping off during flow coating. Preferably, the viscosity of the adhesive is from about 0.5 to about 20 centipoise, and particularly preferred is from about 1 to about 10 centipoise. Viscosities in this range provide acceptable flowability and enable thin coatings which exhibit superior adhesion. It is also desirable for the adhesive to be slow drying in order to avoid trapping solvent in the under-layers which may cause bubble formation. In addition, it is desirable to evaporate the solvent and "cure" the adhesive in the range of from about 5 to about 60 minutes.

Examples of suitable solvents for dissolving the adhesive for coating on the fuser substrate include alcohols such as methanol, ethanol and isopropanol with the preferred solvent being methanol.

It is preferable that the amino silane be present in the amino silane adhesive in solution form in an amount of from about 5 to about 35, preferably from about 20 to about 30, and particularly preferred is about 28 percent by volume (V/V). Therefore, the solvent is present in an amount of from about 65 to about 95, preferably from about 80 to about 70, and particularly preferred is about 72 percent by volume. Total volume as used herein refers to the amount of amino silane and diluent.

The adhesive layer in solution form is then applied to the fuser substrate. The adhesive layer has a thickness of from about 1 to about 10 microns, preferably from about 1 to about 4 microns.

An adhesive may not be necessary if the surface energy of the base material and the mechanical linkage is relatively high.

By use of the above fabric material as a base material, the outer layer(s) are able to retain their strength at higher fusing temperatures. In addition to providing reinforcement, the fabric substrate bonds to the outer surface(s) in a manner which provides sufficient connectivity resulting in a decrease in the occurrence of delamination. The fabric substrates allow for improved flexibility for belt, film, sheet, sleeve, and like applications. By use of flow coating as a preferred method for forming the layer(s), bonding and connectivity is increased and thickness uniformity is improved.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

One Layer VITON® Belt Material

A masterbatch solution of fluoroelastomer (VITON® GF) was prepared as follows. An amount of about 250 grams of VITON® GF was mixed with about 37.5 grams $CaOH_2$, about 1350 grams methyl isobutyl ketone, and about 900 grams methyl ethyl ketone. This mixture was roll milled to dissolve the polymer and disperse the $CaOH_2$. About 10 grams VITON® Curative 50 (from DuPont and comprising a blend of an organophosphonium salt and a dihydroxy aromatic compound) was added to this roll milled solution, and the mixture thoroughly mixed. The mixture was then air dried for about 1 hour. The mixture was then put in an oven at 75° C. for 1 hour to evaporate more of the solvent. Then, the dish was heated an additional 3 hours at 150° C. The mixture was then cured for about 18 hours at 200° C., removed from the oven, and cooled to room temperature (about 25° C.). The material was placed in a spin caster and processed into a belt material using known methods. The belt sample above was placed in a fuser belt fixture and run 40 hours at temperatures of from about 175 to about 200° C., using normal fusing conditions, nip pressure of 90 PSI and dwell time of 30 milliseconds. The belt broke after 40 hours with 6 percent elongation of testing. Strips cut from the same belt, when it was new, were oven tested with static weights of about 50 and about 100 PSI stress levels. The elongation rate of the 100 PSI sample was excessive with over 20 percent creep after 200 hours. The strip creep test elongation rate was about the same as the belt fixture test. Therefore, when tested, too much elongation was observed to function as a long term belt.

Example 2

Two Layer VITON®/KELVAR® Belt Material

The VITON® material prepared in accordance with Example 1 was subsequently coated on top of a rigid polyimide substrate (KELVAR® 55 denier, 1.8 oz/yd$^2$ cloth fiber). The belt was subjected to the same tests as performed in Example 1 and over time several hundred, for example from about 200 to about 500 hours, the VITON® delaminated from the polyimide material.

Example 3

Two Layer VITON®/KELVAR® Cloth Belt

A cloth belt was fabricated by coating VITON® onto a 55 denier, 1.8 oz/yd$^2$ cloth KELVAR® fiber. The coating was applied by rapping the cloth around a 3" mandrel and applied by spray application. The VITON® was coated to a thickness of approximately 5 mils and the KELVAR® was processed to a thickness of about 2 mils. The two layer belt material was then cured at room temperature (25° C.) and then post cured in a step cure for 9 hours with a maximum termperature of 450° F. The belt was subjected to testing as set forth in Example 1. The belt demonstrated improved elongation retension yet also no delamination occurred even after several hundred thousands cycles, for example from about 100,000 to about 200,000, even when brought around sharp curvatures and relatively small radius (e.g., 0.25 inch) rollers. It was also observed that the liquid material penetrated the cloth and no adhesive was required to obtain high bonding strength. Even though the material was sprayed in the cloth, other coating techniques such as flow coating, spin casting, or other liquid thin film coatings can be used. This will enable improved stripping and release perfromance with lower release fluid application.

Example 4

Two Layer Cloth Silicone/KELVAR® Matrix

Silicone Rubber 552 from Sampson Coating, Richmond, Va., was also coated into the KELVAR® material set forth in Example 3. The KELVAR® faric described in Example 3 was again rapped around a 3" mandrel and Silicone 552 was applied using a spray application. The silicone catalyst dibuytl tin diacetate was added using known methods in order to control the rate of crosslinking. The belt was cured at room temperature (25° C.) and then post cured in a step cure for 9 hours with a maximum temperature of 450° F. Silicone is known to have a lower surface energy than the VITON® and is therefore harder to bond to multilayer substrates. The embeded silicone was reinforced with the KELVAR® and improved mechanical strength and adhesion were observed. The silicone matrix can also operate at a lower release agent application rate due to the lower surface energy of the silicone.

Example 5

Multilayer Belt

The adhesion of fuser belts can be improved by enabling the liquid silicone or liquid VITON® material to soak into the faric layers. For example a NOMEX® (polyphenylene isophthalamide from E. I. DuPont of Wilmington, Del.) material can be coated with a liquid silicone material such as Silicone Rubber 552 as in Example 4. A second cloth layer can be applied on top of the silicone layer. Finally, a release layer such as a fluoroelastomer layer (for example, VITON®), can be allowed to soak into the cloth material. By fabricating multilayer fuser belts several advantages can be seen in the fusing process of long term belts. Improved mechanical properties and improved adhesion enable several functional advantages. The improved adhesion enables higher stresses to be applied to the belt to remove paper and toner from the fuser belts. The improved mechanicals and reinforcement of the silicone and release layer matrix will improve wear resistance and extends the belt mechanical life.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A fixing apparatus, comprising:

a) a heater; and in contact with said heater, b) a fixing film comprising a substrate comprising a fabric and having thereon at least one outer layer, wherein an image on a recording material is heated by heat generated from said heater through said fixing film.

2. A fixing apparatus in accordance with claim 1, wherein said fabric is selected from the group consisting of polyimide fabric, polyamide fabric, cotton fabric, graphite fabric, and fiberglass.

3. A fixing apparatus in accordance with claim 2, wherein said fabric is selected from the group consisting of polyamides and polyimides.

4. A fixing apparatus in accordance with claim 3, wherein said fabric is polyphenylene isophthalamide.

5. A fixing apparatus in accordance with claim 1, wherein said at least one outer layer comprises an elastomer selected from the group consisting of silicone rubbers and fluoroelastomers.

6. A fixing apparatus in accordance with claim 5, wherein said elastomer is a fluoroelastomer selected from the group consisting of a) copolymers of vinylidenefluoride, hexafluoropropylene and tetrafluoroethylene, b) terpolymers of vinylidenefluoride, hexafluoropropylene and tetrafluoroethylene and c) tetrapolymers of vinylidenefluoride, hexafluoropropylene, tetrafluoroethylene and a cure site monomer.

7. A fixing apparatus in accordance with claim 6, wherein the fluoroelastomer comprises 35 mole percent of vinylidenefluoride, 34 mole percent of hexafluoropropylene, 29 mole percent of tetrafluoroethylene and 2 percent cure site monomer.

8. A fixing apparatus in accordance with claim 5, said at least one wherein outer layer comprises a volume grafted fluoroelastomer.

9. A fixing apparatus in accordance with claim 1 prepared by flow coating a flow coating solution on said fabric substrate to form said at least one outer layer thereon.

10. A fixing apparatus in accordance with claim 9, wherein said flow coating solution comprises an elastomer, a nucleophilic crosslinking agent, and an effective solvent.

11. A fixing apparatus in accordance with claim 10, wherein said effective solvent is selected from the group consisting of N-methyl 2-pyrrolidone, dimethyl formamide, and dimethyl sulfoxide.

12. A fixing apparatus in accordance with claim 10, wherein said nucleophilic crosslinking agent comprises a material selected from the group consisting of a bisphenol, a quaternary phosphonium salt, hexamethylenediamine carbamate, N,N'-dicinnamylidene-1,6 hexanediamine, and mixtures thereof.

13. A fixing apparatus in accordance with claim 10, wherein said nucleophilic crosslinking agent comprises a bisphenol and a quaternary phosphonium salt.

14. A fixing apparatus in accordance with claim 10, wherein said crosslinking agent is present in an amount of from about 2 to about 6 percent by weight of total solids.

15. A fixing apparatus in accordance with claim 10, wherein said effective solvent is present in an amount of from about 65 to about 85 percent by weight of total solids.

16. A fixing apparatus in accordance with claim 9, at least one wherein said outer layer comprises a fluoroelastomer.

17. A fixing apparatus in accordance with claim 16, wherein said fluoroelastomer is present in an amount of from about 15 to about 35 percent by weight of total solids.

18. A fixing apparatus in accordance with claim 9, wherein said at least one outer layer is applied to said fabric substrate at a thickness of from about 0.001 to about 0.005 inches per pass.

19. A fixing apparatus in accordance with claim 9, wherein from about 95 to about 100 percent of said coating solution applied to said fabric substrate adheres to said fabric substrate.

20. A fixing apparatus in accordance with claim 1, further comprising an intermediate layer positioned between said substrate and said at least one outer layer.

21. A fixing apparatus in accordance with claim 20, wherein said intermediate layer comprises a material selected from the group consisting of fluoropolymers and silicone rubbers.

22. A fixing apparatus in accordance with claim 20, wherein said intermediate layer is prepared by flow coating an adhesive solution onto said substrate to form an intermediate layer.

23. A fixing apparatus in accordance with claim 22, wherein said adhesive solution comprises an amino silane composition and an organic phosphonium catalyst.

24. A fixing apparatus in accordance with claim 23, wherein said amino silane composition comprises 1-propamine 3-(triethoxy)silane, ethynyltriethoxy silane, and benzyltriphenylphosphonium chloride.

25. A fixing apparatus in accordance with claim 1, wherein said at least one outer layer further comprises a metal oxide filler selected from the group consisting of aluminum oxide, cupric oxide and mixtures thereof.

26. A fixing apparatus, comprising:

a) a heater; and in contact with the heater, b) a fixing film comprising a substrate comprising a fabric comprising a material selected from the group consisting of polyimide and polyamide, and having thereon at least one outer layer comprising an elastomer material selected from the group consisting of silicone rubber and fluoroelastomers, wherein an image on a recording material is heated by heat generated from the heater through the at least one outer layer of the fixing film.

27. An image forming apparatus for forming images on a recording medium comprising:

a) a charge-retentive surface to receive an electrostatic latent image thereon;

b) a development component to apply toner to the charge-retentive surface to develop the electrostatic latent image to form a developed image on the charge-retentive surface;

c) a transfer component to transfer the developed image from the charge-retentive surface to a copy substrate; and d) a fixing component for fixing toner images to a surface of the copy substrate, wherein the fixing component comprises 1) a heater; and in contact with the heater, 2) a fixing film comprising a substrate comprising a fabric and having thereon at least one outer layer, wherein an image on a recording material is heated by heat generated from the heater through the at least one outer layer of the fixing film.

* * * * *

UNITED STATES PATENT AND TRADEMARK OFFICE

CERTIFICATE OF CORRECTION

PATENT NO. : 5,999,787
DATED : December 7, 1999
INVENTOR(S) : Robert N. Finsterwalder, et al.

It is certified that error appears in the above-identified patent and that said Letters Patent is hereby corrected as shown below:

ON THE TITLE PAGE:
Item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | 5 | 1 | 6 | 2 | 6 | 3 | 4 | | 11/10/92 | Kusaka, et al. | 219 | 216 | |
| | 5 | 1 | 5 | 7 | 4 | 4 | 6 | | 10/20/92 | Kusaka | 399 | 329 | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 6 | 2 | 1 | 4 | 4 | 9 | 8 | 0 | 6/29/87 | Japan | | | x | (Abs) |
| | 0 | 6 | 1 | 9 | 4 | 9 | 8 | 1 | 7/15/94 | Japan | | | x | (Abs) |
| | 6 | 0 | 1 | 4 | 3 | 3 | 7 | 1 | 7/29/'85 | Japan | | | x | (Abs) |
| | 6 | 2 | 2 | 9 | 3 | 2 | 7 | 0 | 12/19/87 | Japan | | | x | (Abs) |
| | 0 | 3 | 2 | 9 | 3 | 3 | 8 | 5 | 12/25/91 | Japan | | | x | (Abs) |
| | EP | 0 | 8 | 1 | 5 | 9 | 5 0 | A 1 | 1/7/98 | Japan | | | x | |
| | | | | | | | | | | | | | | |
| | | | | | | | | | | | | | | |

Signed and Sealed this

Eleventh Day of July, 2000

*Attest:*

Q. TODD DICKINSON

*Attesting Officer*

*Director of Patents and Trademarks*